United States Patent [19]

Busch et al.

[11] Patent Number: 4,830,030

[45] Date of Patent: May 16, 1989

[54] HAIR CLIP APPLICATOR FOR LIQUIDS AND METHOD

[75] Inventors: Peter Busch, Erkrath; Klaus Thiele, Langenfeld, both of Fed. Rep. of Germany

[73] Assignee: Henkel Kommanditgesellschaft auf Aktien, Duesseldorf, Fed. Rep. of Germany

[21] Appl. No.: 68,859

[22] Filed: Jul. 1, 1987

[30] Foreign Application Priority Data

Jul. 2, 1986 [DE] Fed. Rep. of Germany ..... 3622232

[51] Int. Cl.[4] ..... A45D 7/00; A45D 9/00

[52] U.S. Cl. ..... 132/212; 132/200; 132/108; 401/10; 401/196

[58] Field of Search ..... 132/7, 9, 48 R, 88.5, 132/108, 88.7, 200, 212; 401/196, 10

[56] References Cited

U.S. PATENT DOCUMENTS

| | | | |
|---|---|---|---|
| 2,002,989 | 5/1935 | Steinbach | 132/7 |
| 2,143,740 | 1/1939 | McIntosh | 132/7 |
| 2,463,611 | 3/1949 | Green et al. | 132/108 |
| 2,783,762 | 3/1957 | Mora | 132/7 |
| 3,105,501 | 10/1963 | Scotti | 132/9 |
| 3,369,267 | 2/1968 | Friedland et al. | 401/132 X |
| 3,386,793 | 6/1968 | Stanton | 401/132 |
| 4,385,638 | 5/1983 | Hasegawa | 132/88.5 |
| 4,671,302 | 6/1987 | Hill | 132/48 R |

FOREIGN PATENT DOCUMENTS

| | | | |
|---|---|---|---|
| 662702 | 6/1938 | Fed. Rep. of Germany | 132/9 |
| 2600443 | 10/1976 | Fed. Rep. of Germany . | |
| 2749074 | 5/1979 | Fed. Rep. of Germany . | |
| 7932856 | 2/1980 | Fed. Rep. of Germany . | |

*Primary Examiner*—Steven A. Bratlie

*Attorney, Agent, or Firm*—Ernest G. Szoke; Wayne C. Jaeschke

[57] ABSTRACT

An applicator for hair treating liquids comprising a hair clip in which one or more such liquids are expressed through mutually opposed linings in the jaw face; the combination of the applicator with such hair treating liquids; and a method for using the combination.

19 Claims, 1 Drawing Sheet

HAIR CLIP APPLICATOR FOR LIQUIDS AND METHOD

BACKGROUND OF INVENTION

1. Field of Invention

This invention relates to a hair clip applicator for liquids of which the grips comprise cooperating clamping jaws. The invention also relates to a method for operating this application as well as a combination of the applicator with hair liquids.

2. Statement of Related Art

Hair clips are used in practice for shaping the hair, more especially for forming waves, for holding styled hair in place and also as pieces of jewelry. Hair clips operating on the principle of a clothes pin comprise two grips which are intended to be pressed together by hand about an axis and which are designed as clamping jaws at their longitudinal ends opposite the grip surface (on the other side of the axis). The clamping jaws may differ widely in shape according to the particular application envisaged. For example, they may also be used to hold freshly dyed hair on a curler until the dye has been fixed. However, known hair clips do not play an active part in the dyeing process.

Published German patent application No. 26 00 443 describes an apparatus and process for dyeing or bleaching separated strands of hair different shades. The apparatus described is a comb device with a fluid reservoir in the handle. Squeezing the handle expels a fluid into the comb fingers, for transfer to the hair. The fluid may be a hair dye or a hair bleach. Only a single fluid reservoir is shown in the drawings and only a single fluid mentioned in the English language abstract. It is possible by this process to obtain different colors effects with graduated tones. For example, a strand of hair may be treated, for example lightened or colored, from the scalp to the tip of the strand, at the tip of the strand only, at the base of the strand only or over an intermediate section only. Dyeing is carried out by drawing a strand of hair more or less far between the teeth of the comb-like applicator. Accordingly, the dyed region extends substantially parallel to the axis of the individual hair fiber.

SUMMARY OF THE INVENTION

The present invention provides a device for producing lightening, coloring, tinting or shaping effects or the like on hair. It enables shaped lightening, coloring, tinting, shaping or other visible treatment results to be obtained in the final hair style independently of the longitudinal direction of the individual hair fibers. The invention thus affords a hair clip type applicator for hair treatment liquids, of which the grips comprise cooperating clamping jaws. The mutually opposed surfaces of the clamping jaws comprise linings intended to apply treatment liquids to the hair. The general surface configuration of the opposed faces may be cylindrical, as shown in the drawing, or may be flat or even complementary washboard or other configurations, without limitations. These linings may themselves serve as reservoirs or may communicate with another reservoir acting like a sponge.

The invention preferably provides a hair clip applicator designed on the principle of a clothes pin which, within each clamping jaw, has a reservoir for the same liquid or for different liquids. Each reservoir comprises a surface-active material or cappillary acting like a sponge, similar to a stamp pad, i.e. made of felt, needle felt, nonwoven, textured polymer, or the like. The clamping jaws and, with them, the linings accommodating the particular treatment liquid may be of any shape, for example strip-like, punctiform, star-shaped or rounded, therefore any pattern predetermined by the choice of optionally replaceable linings and clamping jaws may be applied to the particular hair.

The hair treatment liquids used include conditioners, shaping/fixing preparations, such as film formers, lacquers, bleaches, tints, dyes and the like. Although the detailed description herein is for the preferred embodiment of a "clothes pin" type hair clip, it is not intended that this invention be limited to any particular mechanical structure for biasing the jaws of the clip, other than in the concept and disclosure of the opposed face linings comprised within the jaws. Thus, the opposed face lining may be biased against each other by different means, supported within an overall structure, such as a screw or a wing-nut, a barette clamp or the like.

It must be emphasized that the composition of the hair treatment liquid is not relevant to the various embodiments of this invention, other than the logical limitations that (1) it must be effective for its intended purpose (bleaching, dyeing, etc.); (2) it must have a viscosity and other physical properties such that is suitable for temporary or long term storage within the reservoirs comprising the face linings, and (3) it must be expressible from the face linings when the applicator is used. Therefore, any known hair treating liquids are useful, other than those which require motion in their application, such as shampoos. The use itself is simple, the hair to be treated being placed between the opposed face linings with their reservoirs of treating liquid, after the face linings are separated from each other. The biasing force of the device is increased by the pressure of the hair between the faces, which expresses sufficient hair treating liquid to treat that hair. This invention also contemplates the combination of the applicators disclosed herein with the hair treating liquids disclosed herein, and methods for using such combinations.

Since two liquid reservoirs may simultaneously be applied to the same hair for the particular hair treatment according to the invention, the present invention enables the two reservoirs to be filled with different liquids which only effect the hair treatment upon coming into contact with one anothr or with the hair to be treated, optionally after a certain reaction time. It is particularly important in this case to separate the two liquid reservoirs from one another pending application of the liquids. In another embodiment of the invention, therefore, at least one separating film or partition is provided between the mutually opposed linings of the clamping jaws when they contain different liquids. The separating film may also serve as a packaging aid for the two reservoirs, particularly in cases where volatile liquids are used. This safety measure also is particularly important when at least one of the proposed liquids reacts with the surrounding atmosphere and/or gives off noxious or foul-smelling gases. In the latter case, therefore, tearing open of the film before use leads to removal of both the wrapping and of the separating film. In the practical utilization of the hair clip applicator according to the invention, the hair to be treated is clamped between the two reservoir faces, optionally after removal of the separating film. The liquids issuing from the reservoirs as a result of the jaws biasing against each other are mixed in the region of clamped hair so that reaction, (for example oxidation of dye components), takes place and the desired color is formed on the hair. After the particular reaction is completed, (which may take for example half an hour), the color development becomes visible and cannot be washed away.

A major advantage of the invention is that practically any strand of hair may be separately treated. For example, it is even possible to apply streaks transversely of the hair axes or any other desired patterns or formats which depend solely on the shape of the two reservoirs. Finally, each lining may form a single body on each clamping jaw or may be divided one or more times, preferably by a non-permeable linear partition, to accommodate different liquids in the lining of the same clamping jaw in order to obtain special fashion effects in the hair, for example highlights, color spots or ornaments.

The hair clip applicator according to the invention may be designed as a disposable article or as a refillable article so that it may be used several times.

BRIEF DESCRIPTION OF THE DRAWING

One embodiment of the invention is described in detail in the following with reference to the accompanying drawing, wherein.

DETAILED DESCRIPTION OF THE INVENTION

Figure 1:
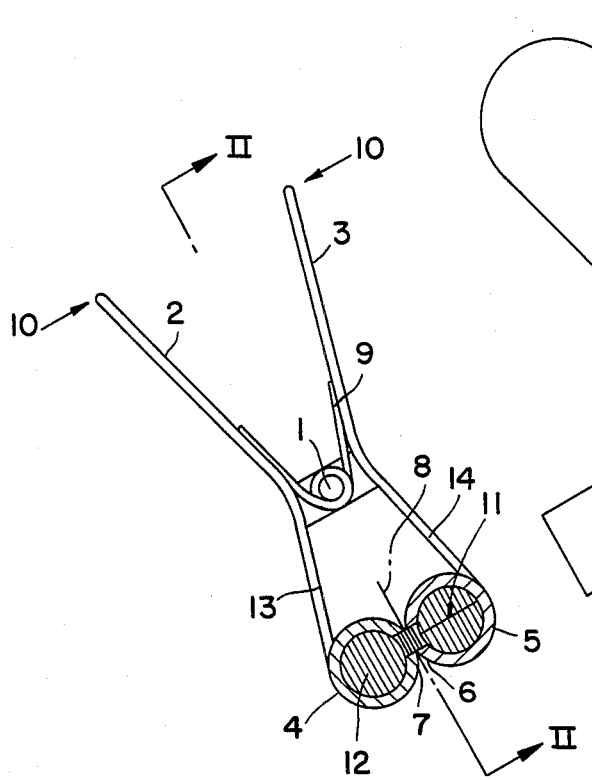
FIG. 1 is a section through the hair clip applicator perpendicularly of the axes of the clamping jaws.
Figure 2:
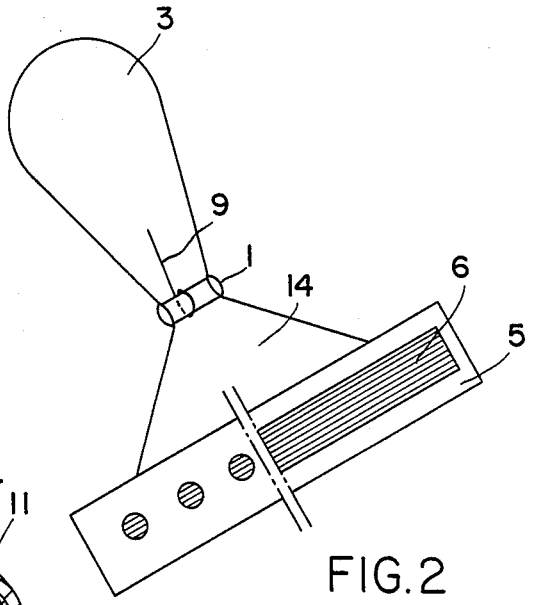
FIG. 2 is a section through the hair clip applicator on the line II—II oF FIG. 1.

The hair clip applicator shown in FIGS. 1 and 2 comprises two grips (left grip 2 and right grip 3) mounted to pivot about an axis 1 and clamping jaws (left jaw 4 and right jaw 5) formed integrally therewith on the other side of the axis 1 and joined thereto by jaw leafs (left leaf 13 and right leaf 14). According to the invention, the clamping jaws 4 and 5 each carry a lining (left lining 7 and right lining 6) which comprises surface-active material in the manner of a stamp pad and which is capable of accommodating a treatment liquid, for example for lightening or coloring human hair. Each lining communicates with a reservoir 12 and faces the opposing lining. The linings 6,7 may be basically of any shape. FIG. 2 shows an overall rectangular shape on the right-hand side. On the left-hand side, the lining comprises a row of circular individual elements. To separate the linings 6 and 7 from one another before use, i.e. before gripping of the hair to be treated, such as where necessary to prevent a premature reaction between the two liquids facing one another in the two linings 6 and 7, a film 8 impermeable to the two liquids may be inserted between the linings. The film may also be used, especially where it is of two-ply construction, for the packaging enclosure of the two linings 6 and 7.

In practical application, the two grips are pressed against one another (to overcome the force of spring 9) in the direction of the arrow 10 so that the two clamping jaws 4 and 5 with the linings 6 and 7 are separated from one another and the film 8 may be withdrawn. The clamping jaws are then applied to the hair to be treated in the desired manner and left there until the intended effect has been achieved.

The linings 6 and 7 may each individually accommodate a treatment liquid or liquid mixture or each individually may be provided with a partition 11 which enables two different treatment liquids or liquid mixtures to be accommodated in one lining 6 divided by the partition 11 and—after removal of the film 8—to react with one another and with the liquid of the opposite lining 7 on the hair.

There are numerous ways of using the hair clips according to the invention to produce different effects, of which the following are exemplary:

EXAMPLE 1

To produce color effect using oxidation hair dyes, one lining is charged with hydrogen peroxide (acidic) and the other lining with a solution of oxidation dye precursors (alkaline) and sodium sulfite.

EXAMPLE 2

To produce color effects using substantive dyes, both linings may be directly charged wit the same or different solutions of substantive hair dyes. Substantive dyes in the dyeing of hair are known to be dyes which contribute toward the coloring of hair without any intermediate or preliminary chemical reactions.

EXAMPLE 3

For mild bleaching, one lining may be charged with aqueous (stabilized) hydrogen peroxide solution (acidic) and the other lining with aqueous ammonia solution.

EXAMPLE 4

For heavy bleaching, a divided lining is charged with separately accomodated hydrogen peroxide and peroxide sulfate while the other (undivided) lining is charged with aqueous ammonia solution.

EXAMPLE 5

To fix certain parts of the hair (with and without color effects), the linings are charged with film former (and optionally substantive dye) solution.

The following U.S. patents disclose hair treating liquids/creams of the type which may be used in the inventive applicators, all of which patents are incorporated herein by reference: U.S. Pat. Nos. 4,552,565; 4,575,377; 4,629,466; 4,487,607; 4,371,370; 4,322,212; 4,325,704; 4,314,809; 4,226,595; 4,217,758; 4,129,413; 4,129,414; and Re. 30,199. Of the foregoing, compositions disclosed in U.S. Pat. Nos. 4,314,809; 4,217,758; and Re. 30,199 are most useful, particularly those disclosed in Example 5 of U.S. Pat. No. 4,314,809.

We claim:

1. An applicator for hair treating liquids comprising: a hair clip with:

at least two cooperating opposed clamping jaws;

bias means for biasing said jaws against each other when said applicator is in repose;

means for temporarily opening said jaws upon the manual application of a force sufficient to overcome said biasing;

each said jaw comprising a mutually opposed face lining consisting essentially of a surface-active material having sponge-like characteristics, for providing a dispenser-reservoir, for dispensing at least one hair treating liquid;

at least one removable separating partition inserted between said opposed face linings, said separating partition being a separating film which also comprises a part of an outside packaging for said applicator; and a non-permeable partition for dividing at least one said face lining at least one time along its length, for providing at least two independent dispenser-reservoirs in said one lining.

2. An applicator for hair treating liquids comprising: a hair clip with:

at least two cooperating opposed clamping jaws;

bias means for biasing said jaws against each other when said applicator is in repose;

means for temporarily opening said jaws upon the manual application of a force sufficient to overcome said biasing;

each of said jaws comprising a reservoir for containing hair treating liquid, a mutually opposed face lining covering a portion of and communicating with its associated reservoir, said face lining consisting essentially of a surface-active material having sponge-like characteristics, which is capable of acting as a dispenser-conduit for dispensing at least one hair treating liquid from its associated reservoir, wherein at least one removeable separating partition is inserted between said opposed face linings, said separating partition being a separating film which also comprises a part of an outside packaging for said applicator, and at least one said face lining is divided at least one time along its length by a non-permeable partition, for providing at least two independent surfaces in said one lining.

3. The applicator of claim 2, wherein said surface-active material of the face lining consists of fibrous material.

4. The applicator of claim 2, wherein each said face lining has a predetermined configuration, complementary to a similar configuration in the opposed lining.

5. The applicator of claim 2 further including said non-permeable partition penetrating into its associated reservoir for dividing said reservoir into sections, for storing different hair treating liquid in each section, whereby said independent surfaces of said lining communicate with associated ones of said reservoir sections, respectively.

6. The applicator of claim 5 including a multi-component hair treating liquid composition, wherein one component is initially stored in said undivided reservoir, and the other components are stored individually in sections of said divided reservoir, said components being absorbed by their associated said face linings, respectively.

7. The applicator of claim 2, including similar hair treating liquid compositions in said reservoirs, for absorption in each mutually opposed face lining, respectively.

8. The applicator of claim 2 including a two component hair treating liquid composition, with one component being stored in one reservoir, the other component in the other reservoir, the components being absorbed by their associated face lining.

9. The applicator of claim 2, wherein said surface-active material of the face lining consists of felt.

10. The applicator of claim 2, wherein said surface-active material of the face lining consists of non-woven material.

11. The applicator of claim 2, wherein said surface-active material of the face lining consists of textured polymer material.

12. In an applicator for hair treating liquids, wherein said applicator includes at least two cooperating clamping jaws, each of said jaws including reservoir means for containing hair treating liquid, and mutually opposing face lining communicating with its associated reservoir, said face lining consisting of absorbent material for providing a dispenser conduit, for dispensing at least one hair treating liquid from its associated reservoir, the method comprising the steps of:

inserting a separating partition between said opposed face linings;

biasing said jaws against one-another;

dividing at least one of said face linings and its underlying reservoir into a plurality of independent sections;

charging each of said reservoirs with a predetermined hair treating liquid, a portion of said liquid being absorbed into said face linings associated with said reservoirs, respectively:

removing said separating partition by opening said jaws, to activate said applicator;

clipping said applicator around a portion of hair to be treated; and removing said applicator from said hair after a predetermined treatment time.

13. The method of claim 12, further including in said charging step, the steps of independently charging said reservoirs with individual components of a multicomponent hair treating composition.

14. The method of claim 12, for charging said applicator with an oxidation hair dye, further including in said charging step the steps of:

charging said reservoir and face lining of one jaw with hydrogen peroxide (acidic); and charging the opposing face lining and reservoir of the other jaw with a solution of oxidation dye precursors (alkaline) and sodium sulfite.

15. The method of claim 12, for charging said applicator with a substantive dye, further including in said charging step the steps of:

charging one face lining and its associated reservoir with a substantive dye; and charging the opposing face lining and associated reservoir with either the same or a different substantive dye.

16. The method of claim 12, for charging said applicator with a substantive dye, further including in said charging step the steps of:

charging one face lining and its associated reservoir with aqueous (stabilized) hydrogen peroxide solution (acidic); and charging the opposed face lining and its associated reservoir with aqueous ammonia solution.

17. The method of claim 12, for charging said applicator with a heavy bleach, further including in said charging step the steps of:

charging half of the divided one of said face lining and associated reservoir with hydrogen peroxide, and the other half thereof with peroxide sulfate; and charging the opposed face lining and its associated reservoir with aqueous ammonia.

18. The method of claim 12, for charging said applicator with a fix with color effects, further including in said charging step the steps of:

charging the opposed said face linings and their associated reservoirs each with a film former and substantive dye.

19. The method of claim 12, for charging said applicator with a fix without color effects, further including in said charging step the steps of:

charging the opposed said face linings each with a film former.

* * * * *